US007015403B2

(12) United States Patent
Houck, III et al.

(10) Patent No.: US 7,015,403 B2
(45) Date of Patent: Mar. 21, 2006

(54) DISCONNECTING HANDLE WITH AUXILIARY CONTACTS FOR USE WITH CDM

(75) Inventors: Theodore J. Houck, III, Milwaukee, WI (US); Jeffrey John Battani, Waterford, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/882,420

(22) Filed: Jul. 1, 2004

(65) Prior Publication Data

US 2006/0000696 A1 Jan. 5, 2006

(51) Int. Cl.
*H01H 9/20* (2006.01)

(52) U.S. Cl. ..... 200/50.05; 200/50.12

(58) Field of Classification Search .. 200/50.01–50.07, 200/50.11–50.13, 50.26, 329–338, 318–324, 200/43.01–43.22

See application file for complete search history.

(56) References Cited

U.S. PATENT DOCUMENTS

| | | | | | |
|---|---|---|---|---|---|
| 1,404,865 | A | * | 1/1922 | Kries | 200/17 R |
| 1,417,920 | A | * | 5/1922 | Jessen | 200/50.07 |
| 2,053,997 | A | * | 9/1936 | Krcek | 200/50.07 |
| 2,258,232 | A | * | 10/1941 | Atwood et al. | 200/337 |
| 2,368,083 | A | * | 1/1945 | Adam | 200/18 |
| 2,761,041 | A | | 8/1956 | Yarrick | |
| 4,052,582 | A | | 10/1977 | Mullen et al. | |
| 5,288,958 | A | * | 2/1994 | Grunert et al. | 200/331 |
| 5,772,011 | A | | 6/1998 | Dumont | |
| 6,342,995 | B1 | | 1/2002 | Jones | |
| 6,492,606 | B1 | | 12/2002 | MacLean | |
| 2004/0099515 | A1 | | 5/2004 | Houck, III | |

FOREIGN PATENT DOCUMENTS

| | | |
|---|---|---|
| DE | 29513405 | 11/1995 |
| FR | 96 14559 | 11/1996 |

* cited by examiner

*Primary Examiner*—Lincoln Donovan
*Assistant Examiner*—M. Fishman
(74) *Attorney, Agent, or Firm*—Quarles & Brady LLP; Alexander M. Gerasimow

(57) ABSTRACT

A handle assembly for use with a planar member forming an opening and having first and second sides, the assembly including a handle member moveable between at least first and second positions and mounted on the second side of the planar member adjacent the opening, an extension member rigidly connected to and extending from the handle member through the opening, a cam at least linkable to at least one of the handle member and the extension member for movement therewith and at least a first contact including a activation member, the first contact closing when the activation member is activated, the cam, extension member and activation member positionable in a first relative juxtaposition with respect to each other such that when the handle member is in one of the first and second positions, the cam activates the activation member and, when the handle member is in the other of the first and second positions, the cam releases the activation member.

30 Claims, 13 Drawing Sheets

DISCONNECTING HANDLE WITH AUXILIARY CONTACTS FOR USE WITH CDM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to electrical circuit disconnecting means (CDM) for mounting in cabinets and having a forwardly-extending, rotary disconnect that engages a handle on a cabinet door when the cabinet door is closed, and in particular to an improvement in such CDM that provide visual indications of assembly states outside the cabinet as well as provide auxiliary contacts within the cabinet that are controllable irrespective of the position of the door.

Hereinafter, unless indicated otherwise and in order to simplify this explanation, the present invention will be described in the context of a breaker assembly that includes a circuit breaker. Nevertheless, it should be appreciated that the concepts described herein are also applicable to other types of CDM including fusible disconnects, non-fused disconnects, etc.

Referring to FIG. 1, a standard breaker assembly 10 of the prior art includes several components mounted within a cabinet 12 including a door 20 and several components mounted to the door 20. In the illustrated example, the components within the cabinet include a circuit breaker 16, a power contactor 18 and a disconnector or disconnect means 33. Circuit breaker 16 is a three phase breaker including three switches 25, 26 and 58 as well as an auxiliary switch 29.

Contactor 18 includes three power contacts 56, 50 and 42, a relay coil 44 and two control or auxiliary contacts 51 and 54. Contacts 56, 50, 42 and 54 are normally open while contact 51 is normally closed.

Three phase high voltage power is provided to breaker 16, a separate phase provided to each of switches 25, 26 and 58. Similarly single phase low voltage power is provided to switch 29 as well as to each of auxiliary contacts 51 and 54. Each of switches 25, 26 and 58 is linked in series with a separate one of power contacts 56, 50 and 42 while auxiliary switch 29 is linked in series with coil 44. The output of each power contact 56, 50 and 42 feeds a different phase of a three phase load (e.g., a motor). Each of power contacts 56, 50 and 42 as well as auxiliary contacts 51 and 54 is controlled by relay coil 44 such that, when coil 44 is de-energized, the contacts assume their normal condition and, when coil 44 is energized, the contacts transition to their exited states (i.e., normally open contacts close and normally closed contacts open).

In operation, breaker 16 is automatically controlled as a function of system operating parameters to either close switches 25, 26 and 58 thereby providing power to contactor 18 and to close switch 29 thereby exciting coil 44 and in turn transitioning contacts 56, 50, 42, 51 and 534 or to open switches 25, 26, 58 and 29 thereby cutting off power to contactor 18 and de-energizing coil 44.

Referring still to FIG. 1, components in the illustrated example that are mounted to cabinet door 20 include a handle member or handle 24 and "On" and "Off" lights 60 and 22, respectively. On light 60 is linked to auxiliary contact 54 and lights up when contact 54 is closed. Similarly, light 22 is linked to contact 51 and lights up when contact 51 is closed.

Manual disconnector 33 is a mechanical assembly that links to handle 24 and that can be used to manually open the switches in breaker 16. To this end, referring to FIGS. 1 and 2, a shaft 30 extends from breaker 16 toward door 20 and is rotatable about its axis of extension to electrically open and close breaker switches 25, 26, 58 and 29.

Handle 24 is configured to engage the distal end 31 of shaft 30. In particular, a pair of cylindrical locking pins 34 extends horizontally outwardly from either side of the distal end 31 of shaft 30. An extension member 32 extends from the rear side of handle 24 through an opening in door 20, forms a corresponding keyhole 36 that faces into cabinet 12 and includes a first horizontally extending slot 38 sized to receive locking pins 34. Key hole 36 further includes a second vertically extending slot 40 that intersects with slot 38 and is sized to receive the outer end 31 of shaft 30.

During operation, when door 20 is closed, shaft 30 and corresponding locking pins 34 are inserted into keyhole 36 of extension member 32. Handle 24 and member 32 are subsequently rotated counterclockwise along the direction of arrow A, which causes keyhole 36 to correspondingly rotate shaft 30 counterclockwise in the direction of arrow B. Here, rotation in the direction of arrow B closes the breaker switches while rotation in the opposite direction manually opens the switches. As handle 24 is rotated in the direction of arrow A, a door latch (not illustrated) locks door 20 in a closed position. Accordingly, in order to subsequently open door 20, handle 24 is rotated clockwise to unlock door 20 and automatically rotate shaft 30 to open the breaker switches and cut off power to the load. Thus, a user is therefore advantageously unable to access the interior of cabinet 10 without first disconnecting the power contactor 18 from the power source via handle 24.

Here it should be appreciated that the breaker system described above is simplified and is only exemplary and that many other more complex breaker systems exist. For instance, in some cases the breaker 16 may includes many more switches and/or may feed additional contactors or other relay components. As another instance, additional auxiliary contacts may be provided as well as additional lights to indicate other system and component transitional states.

Unfortunately, while the above described assembly facilitates relatively safe breaker operation, the assembly has several shortcomings. First, when assembly components fail, it is relatively difficult to determine the cause of failure using the above described assembly. To this end, referring still to FIGS. 1 and 2, assume that attempts to provide power from the supply lines to the load through cabinet 12 have failed. To identify the cause of failure, with the cabinet door closed, a system operator may attempt transitioning the assembly components and listen for audible tell tale signs of what is going on inside the cabinet. Unfortunately this solution is not very useful as audible noise from the closed cabinet is often difficult to ascribe to the various components mounted therein when the door is closed.

Another solution for determining the source of failure is to open up the cabinet door 20 and visually inspect the components inside the cabinet 12. Consistent with the description above, to open door 20, a system operator turns handle 24 and disconnector 33 to the off position thereby cutting power to contactor 18 and to coil 44. Thereafter, the operator opens door 20 to observe and inspect the components mounted in cabinet 12. While some failures result in easily observable damage to components, in many cases failures do not cause visually recognizable damage. For instance, in some cases normally open power contactor contacts may stick or fuse closed and the fused contacts may not be positioned in any easy to observe orientation or, the source of the sticking may not be readily visually observable. In other cases additional relay contacts may be stuck in abnormal transitional states. In still other cases one or more of the lights (e.g., 60, 22, etc.) used to indicate handle and system states may be burnt out.

Still one other solution for identifying the source of failure is to cause the cabinet mounted components to transition between states while the cabinet door is open. Thus, for instance, referring again to FIG. 1, with door 20 open, a system operator may use a pliers or the like to manually rotate shaft 30 into the On state wherein switches 25, 26, 58 and 29 are closed at which time coil 44 should excite and transition contacts 56, 50, 42, 51 and 54. When contactor 18 transitions between states, a noise can typically be heard (e.g., "ker klunk") which is recognizable as a state transition. Thereafter the user can transition the breaker again by turning the shaft in the opposite direction to the Off position. While processes that provide power to power contactors and to the power contactor coil while the cabinet door is open are known, clearly these processes are relatively hazardous due to power flow and therefore should be avoided whenever possible.

Second, the assembly described above requires many parts, requires a good deal of time and labor to configure and therefore is relatively expensive. For instance, three separate holes have to be formed in door 20 to mount handle 24 and lights 60 and 22 and then each of those components have to be separately mounted. In many cases the mounting structure for each of the components includes several screws or the like. Exacerbating matters, many breaker assemblies will include several additional lights and control tools such as buttons, knobs, etc, each of the control tools requiring its own door hole or holes to accommodate mounting assemblies. As another instance, after lights are mounted to door 20, wiring has to be run form the lights to the associated auxiliary contacts and power source which increases configuration costs and time considerably.

Third, in most cases breaker assemblies cannot be easily modified to alter assembly functionality. Thus, for instance, where a system operator wants to modify the auxiliary contact logic so that light 60 marked in FIG. 1 as "On" instead illuminates when the handle is in a tripped position, the operator has to rewire light 60 to other system components and, in fact, may also have to add additional components (e.g., another relay) to the assembly.

Fourth, when separate components are provided on door 20 to facilitate control and to indicate assembly states, the front face of the door becomes excessively crowded and cumbersome to use. This is particularly true in cases where the number of status or state lights is appreciable.

Thus, a need exists for a simple, easy to configure, aesthetically pleasing, relatively inexpensive handle assembly that eases the task of diagnosing the health of breaker components.

BRIEF SUMMARY OF THE INVENTION

It has been recognized that a handle assembly may be provided for interacting with a circuit disconnect means where the handle assembly includes auxiliary contacts that are activated by the handle assembly movement itself and independently of the state of the disconnect means. Here, the handle mounted auxiliary contacts can be used to control and test control circuitry within the cabinet with the cabinet door open or closed by placing one or more of the handle controlled contacts in control circuits. In addition, the auxiliary contacts can be linked to lights that reside on the external surface of a cabinet door so that contact state can be visually identified. Moreover, the contacts can be used as trip indication contacts (e.g., linked to trip lights), on/off status contacts (e.g., linked to on/off lights), etc.

It has also been recognized that one or more lights can be provided as integral parts of a handle assembly thereby reducing the costs associated with assemblies that require both a handle and one or more lights as well as reducing the amount of labor required to assemble the assembly. In at least some embodiments, where lights are provided as part of the handle assembly, electricity can be provided to the lights through the same door opening through which the handle extends to link to the disconnect means.

Moreover, it has been recognized that both lights and auxiliary contacts can be provided as part of a disconnect handle assembly and additional functionality can be provided. For instance, the contacts may be linked in series with the lights to indicate handle positions. In some cases some of the lights may be linked to the handle mounted auxiliary contacts while other lights are linked to contacts within the control circuitry in the cabinet. Other configurations are contemplated.

Consistent with the above, at least some inventive embodiments include an apparatus for use with a control assembly including a power source and a circuit disconnector located on a first side of a planar member forming an opening, the disconnector including a first mechanical linkage having open and closed positions, the apparatus for manipulating the mechanical linkage between the open and closed positions and visually indicating on a second side of the planar member at least a first state of the control assembly when the first state occurs, the apparatus comprising a handle assembly including a handle member moveable between at least first and second positions and positioned on the second side of the planar member adjacent the opening, an extension member rigidly connected to and extending from the handle member through the opening and forming a second mechanical linkage at a distal end that is linkable with the first mechanical linkage on the first side of the planar member, the extension member moving the first mechanical linkage between the closed and open positions when the handle is moved between the first and second positions, respectively and at least a first light emitter positioned on the second side of the planar member and at least a first contact linkable between the power source and the first light emitter that closes to provide power to the first light emitter when the first state occurs.

In addition, some embodiments include a handle assembly for use with a control assembly including a power source and a circuit disconnector located on a first side of a planar member forming an opening, the disconnector including a first mechanical linkage having open and closed positions, the assembly comprising a handle member moveable between at least first and second positions and positioned on the second side of the planar member adjacent the opening, an extension member rigidly connected to and extending from the handle member through the opening and forming a second mechanical linkage at a distal end that is linkable with the first mechanical linkage on the first side of the planar member, the extension member moving the first mechanical linkage between the closed and open positions when the handle is moved between the first and second positions, respectively and at least a first light emitter positioned on the second side of the planar member and including conducting leads that extend from the first side to the second side of the planar member.

Moreover, some embodiments include a handle assembly for use with a control assembly including a circuit disconnector located on a first side of a planar member forming an opening, the disconnector including a first mechanical linkage having open and closed positions, the assembly comprising a handle member moveable between at least first and second positions and mounted on the second side of the planar member adjacent the opening, an extension member rigidly connected to and extending from the handle member through the opening and forming a second mechanical linkage at a distal end that is linkable with the first mechanical linkage, the extension member moving the first mechanical linkage between the closed and open positions when the handle is moved between the first and second positions, respectively, a cam at least linkable to the extension member for movement therewith on the first side of the planar member and at least a first contact including a activation member, the first contact closing when the activation member is activated, the cam, extension member and activation member positionable in a first relative juxtaposition with respect to each other such that when the handle member is in one of the first and second positions, the cam activates the activation member and, when the handle member is in the other of the first and second positions, the cam releases the activation member.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

Figure 1:
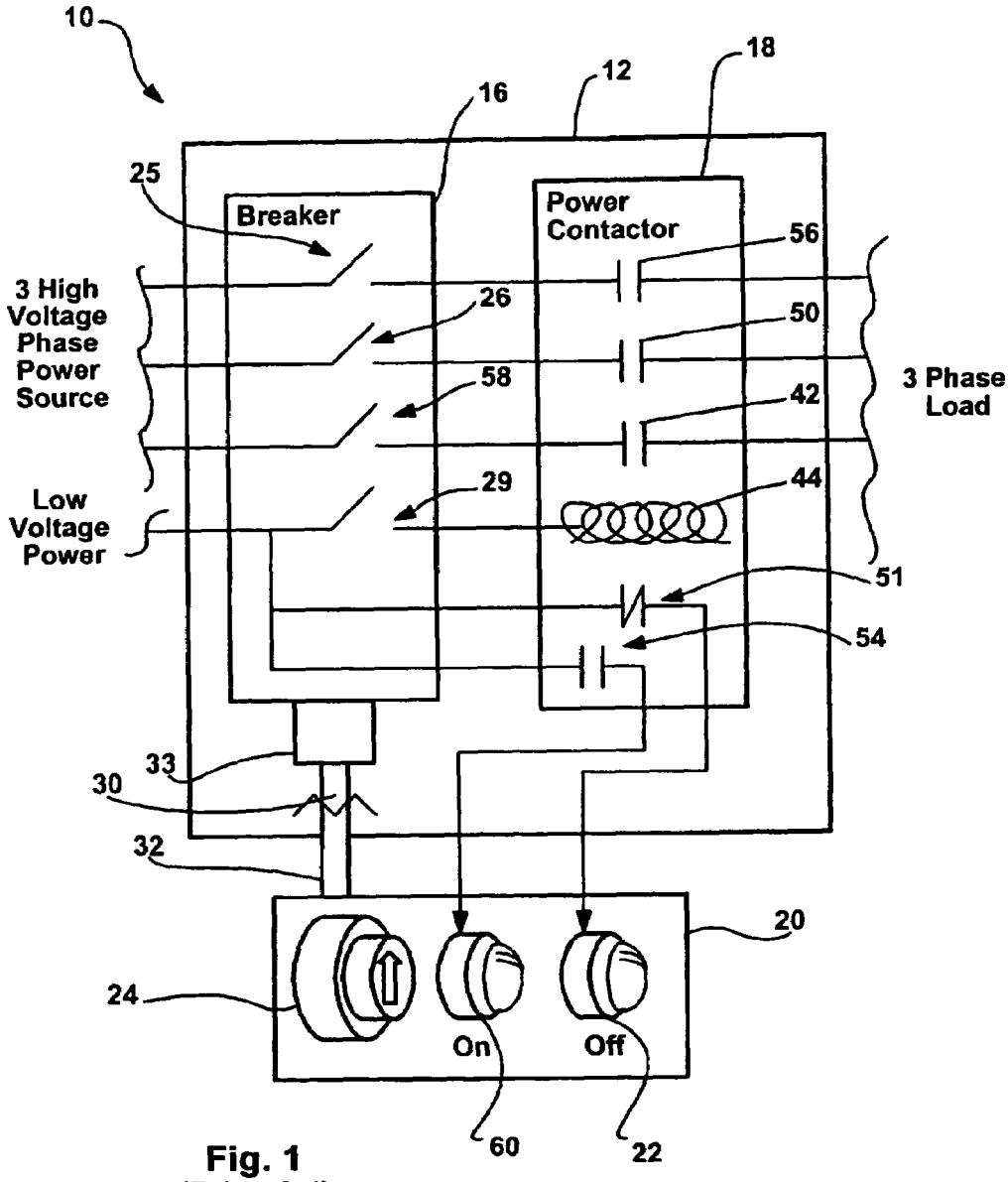
Fig. 1 (Prior Art)
FIG. 1 is a schematic diagram illustrating a prior art breaker block assembly.
Figure 14:
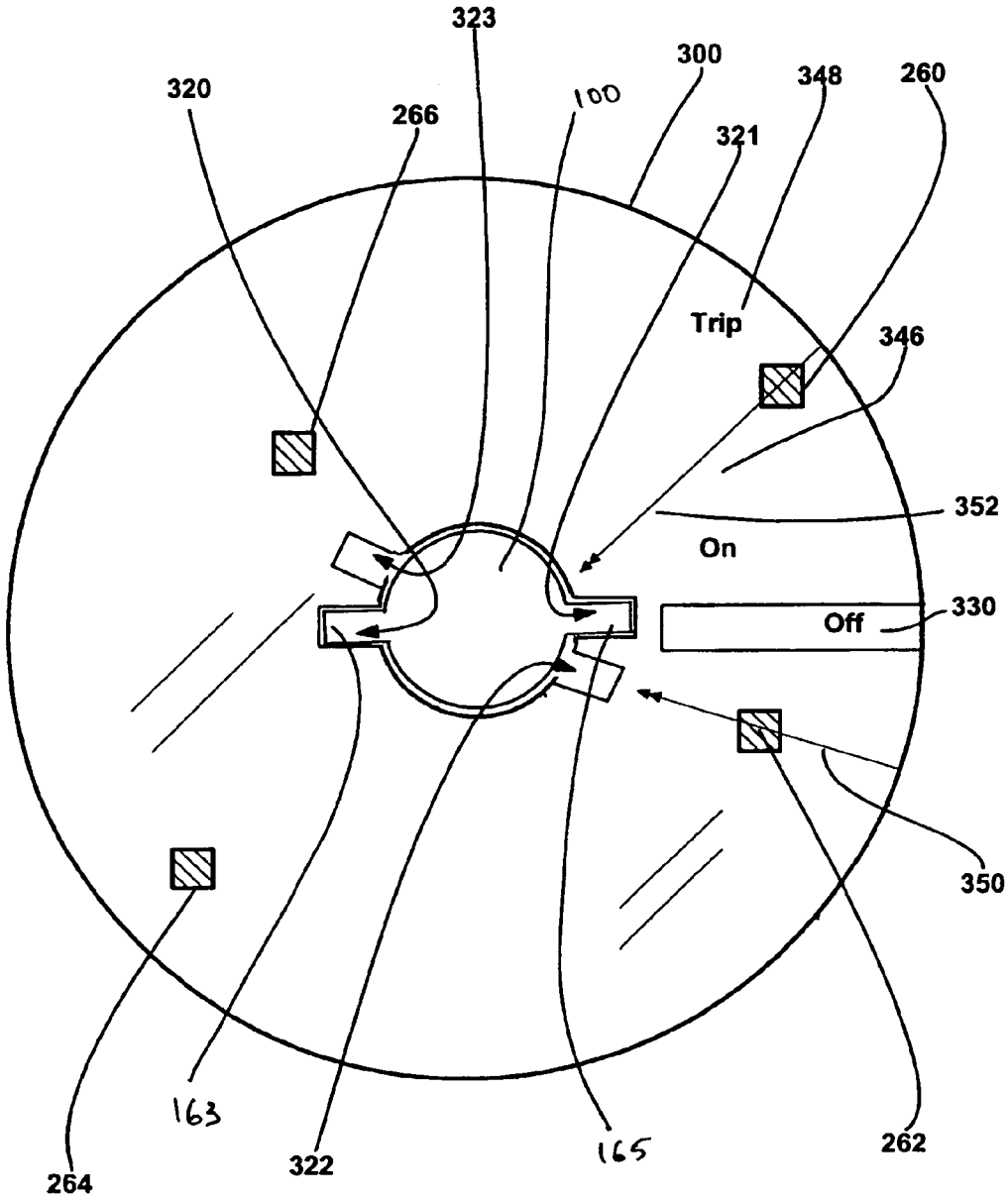
FIG. 14 is similar to FIG. 13, except that the cam member is in a second relative juxtaposition.
Figure 15:
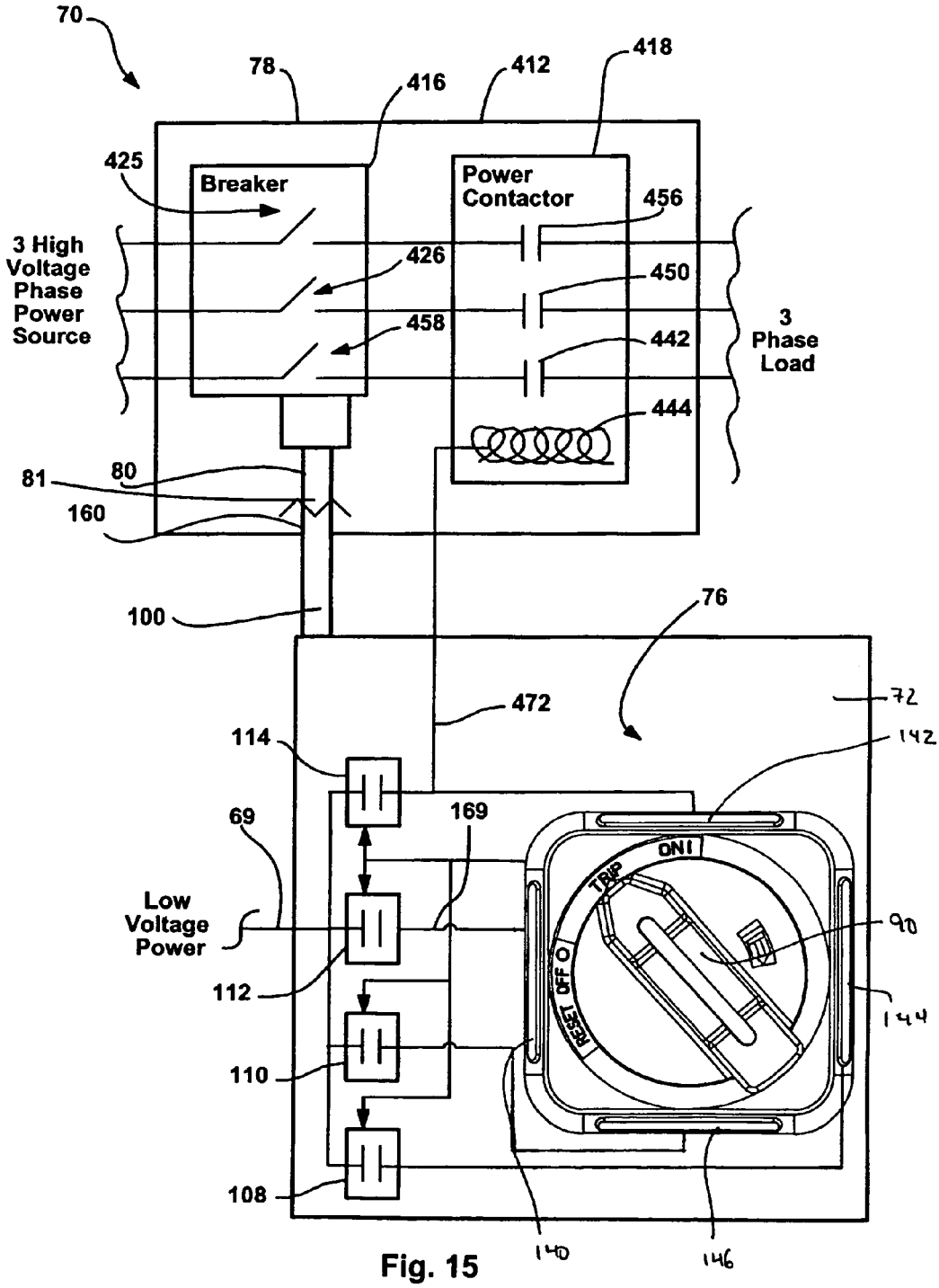
FIG. 15 is a diagram similar to that illustrated in FIG. 1, albeit showing one handle assembly embodiment consistent with certain aspects of the present invention.

Referring now to the drawings wherein like reference numerals correspond to similar elements throughout the several views and, more specifically, referring to FIGS. 3 and 4, the present invention will be described in the context of an exemplary breaker block 70 including a rigid metallic cabinet 71, a cabinet door 72, a breaker assembly 78, a mechanical disconnect assembly 99 and an inventive handle assembly identified generally by numeral 76. Cabinet 71 is a rectilinear box including a back wall 74 opposite an open front face. Referring also to FIG. 14, three-phase power is provided to cabinet 71 via three supply lines (not labeled) and three supply lines exit cabinet 71 and are linked to a load. Breaker assembly 78, as illustrated in FIG. 15, includes a three-phase circuit breaker 416 and a power contactor 418 that are similar to the breaker and contactor described above with respect to FIG. 1. In FIG. 15, breaker 416 includes three breaker switches 425, 426 and 458 while power contactor 418 includes a contactor coil 444 and three power contacts 456, 450 and 442. Switch 425 and contact 456 are linked in series in a first of the three power phases. Similarly, switch 426 and contact 450 are linked in series with the second of the three power phases and switch 458 and contact 442 are linked in series with the third of the three power phases. Contacts 456, 450 and 442 are each normally open contacts.

Figure 2:
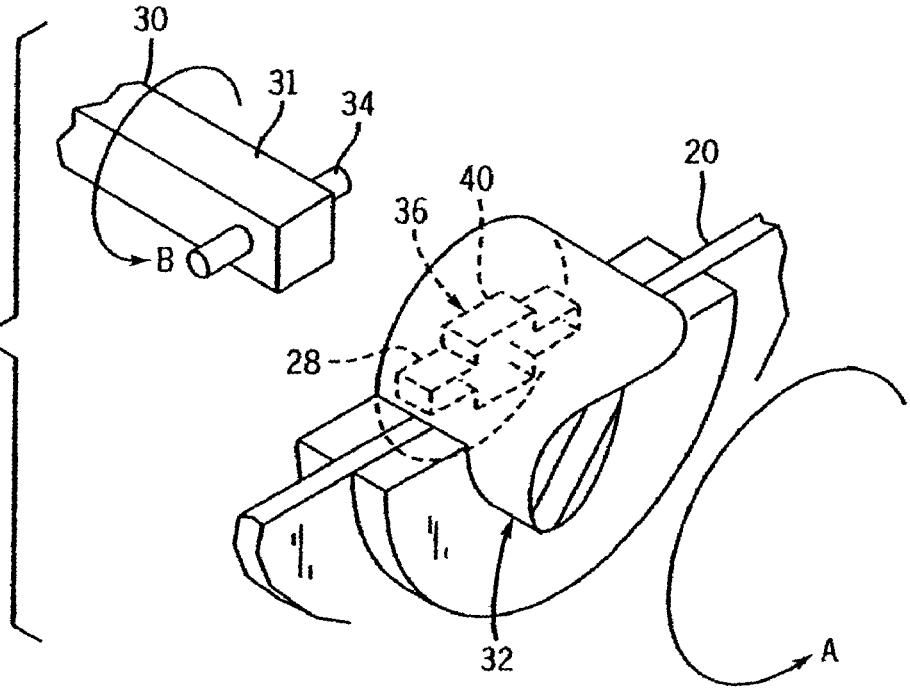
FIG. 2 PRIOR ART
FIG. 2 is a partial perspective view of the linking portions of a handle and a disconnect shaft as known in the prior art.
Figure 3:
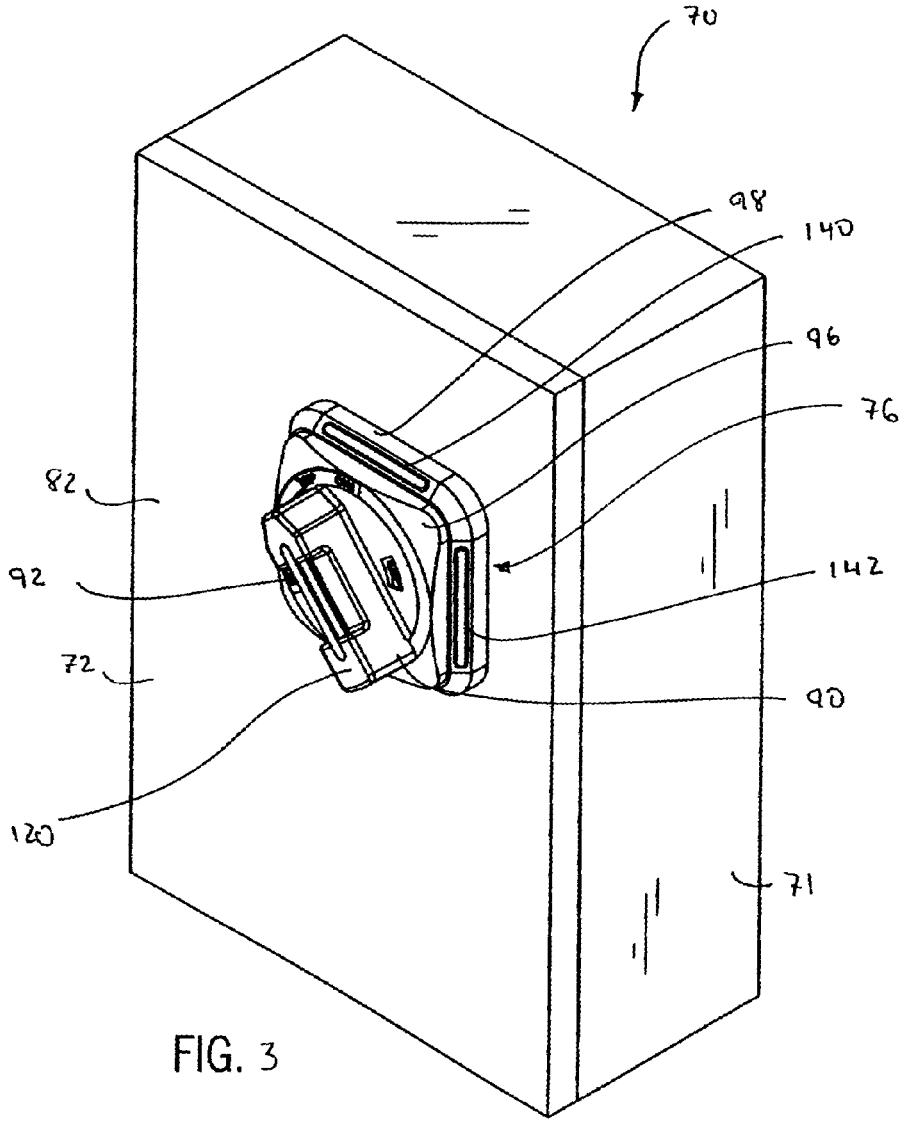
FIG. 3 is a perspective view of a circuit breaker block including a handle assembly consistent with certain aspects of the present invention.
Figure 4:
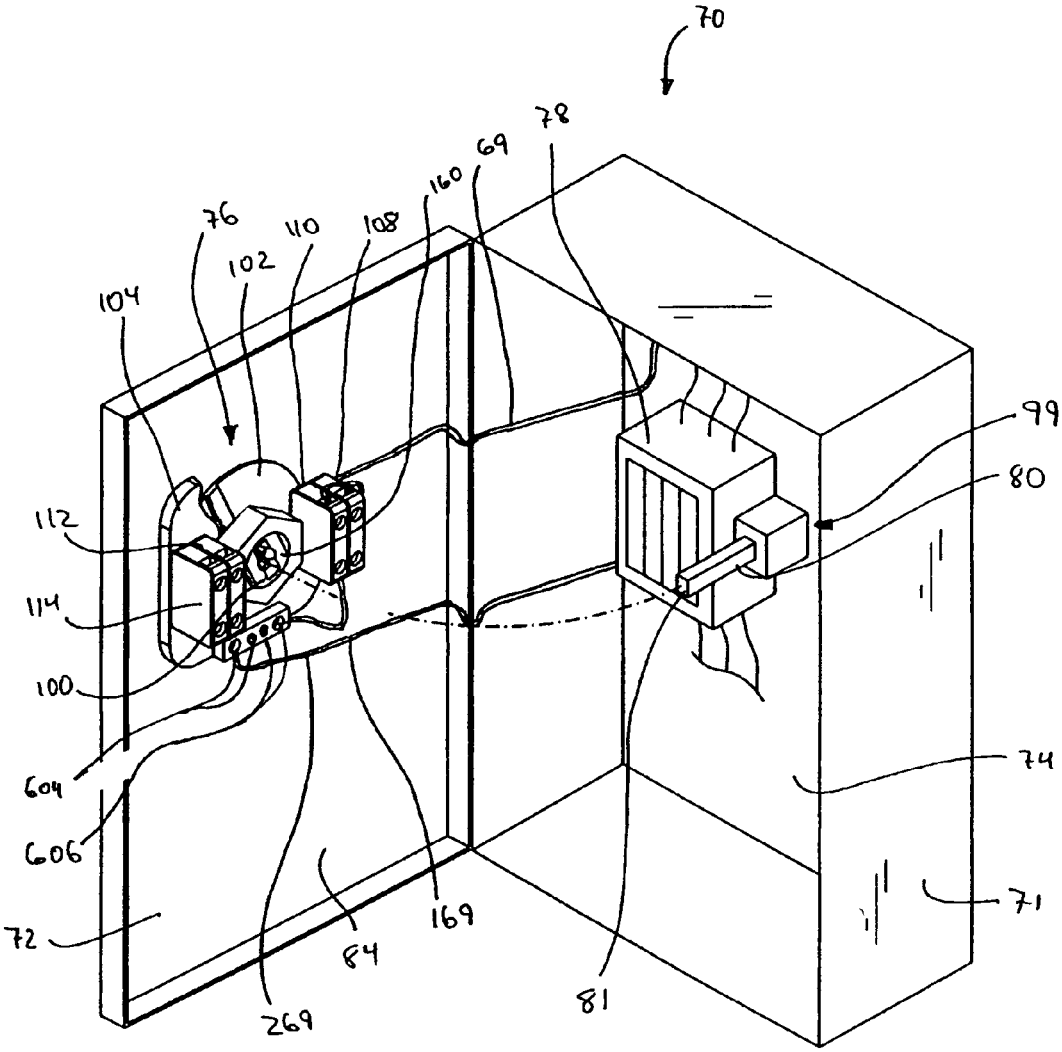
FIG. 4 is a perspective view of the assembly of FIG. 3, albeit with a cabinet door in an open position.

Referring still to FIGS. 3, 4 and 15, disconnect assembly 99 includes a shaft 80 that extends from breaker 416 toward door 72 and is rotatable about its axis of extension to electrically open and close breaker switches 425, 426 and 458. An internal or distal end 160 of a handle assembly extension member 100 is keyed so as to receive and be linkable to distal end 81 of shaft 80. Herein, in the interest of simplifying this explanation, the specifics with respect to how keyed distal end 160 links to shaft end 81 and latches thereto will not be described in detail. It should suffice to say that the cooperating ends 160 and 81 latch together in a manner similar to that described above with respect to FIG. 2 such that when distal end 160 is rotated, shaft 80 likewise rotates. In addition, it should be noted that, when shaft 80 is rotated into a position where breaker switches 425, 426 and 458 are open, handle assembly 76 can be manipulated to separate ends 160 and 81 so that door 72 can be opened. Similarly, when shaft 80 is rotated such that breaker switches 425, 426 and 458 are closed and power is provided to contactor 418, distal end 160 is latched to end 81 and handle assembly 76 cannot be manipulated to de-latch ends 160 and 81 until the breaker switches are open.

Referring to FIG. 15, various aspects of the present invention are related to the construction and operation of handle assembly 76. In at least some embodiments of the present invention, one inventive aspect of handle assembly 76 is that one or more light emitters 140, 142, 144 and 146 are provided via the handle assembly 76 itself. By providing the light emitters via handle assembly 76, an esthetically pleasing assembly design results where lights to annunciate handle or breaker block status and the handle mechanism are provided in a relatively compact and elegant package. In addition, by providing the light emitters via handle assembly 76, in at least some embodiments of the present invention, only a single hole has to be made in cabinet door 72 to mount components that previously required several holes. For instance, where four separate lights and one handle are required to configure a breaker block for a specific application, while prior configurations required five separate door holes, one for the handle assembly and a separate hole for each of the lights, in at least some inventive embodiments, a single handle assembly including a handle and four lights can be mounted in a single door hole and electrical leads for all four lights can pass through the single hole along with the handle component that mechanically links to the disconnect assembly shaft 80.

Moreover, in at least some inventive embodiments a simplified mounting configuration will be employed to mount the inventive handle assembly. For instance, in at least some embodiments a single nut may be provided to secure the entire handle assembly to the door.

In addition, referring still to FIG. 15, in at least some embodiments of the present invention, one or more auxiliary contacts 108, 110, 112, 114, etc., may be provided as part of the handle assembly 76 itself that are controllable to transition between closed and open states directly via manipulation of the assembly 76 as opposed to indirectly through the disconnect assembly 99. Here, because handle member 90 directly controls the state of the auxiliary contacts that comprise part of the handle assembly 76, the handle assembly 76 can be used to transition the states of the contacts independent of whether or not door 72 is open or closed (i.e., independent of whether or not the handle assembly 76 is linked or delinked from disconnector shaft 80 (see again FIG. 4)).

With auxiliary contacts that are directly controlled by handle assembly manipulation, various useful control circuits can be configured. For example, referring still to FIG. 15, even if end 160 of extension member 100 is decoupled from shaft 80 with breaker 416 switches open, one of the handle assembly auxiliary contacts 114 may be provided in series with contactor coil 444 so that, when handle assembly 76 is manipulated into the ON position, handle assembly 76 directly closes contact 114 thereby providing power to coil 444 despite the fact that breaker 416 remains open. When power is provided to coil 444, contactor contacts 456, 450 and 442 transition to their closed states. When contactor 418 transitions between the closed and open states, a distinctive noise recognizable as a transitioning contactor can be heard which can be used to verify that contactor 418 is operating properly. Similarly, handle assembly 76 can be manipulated into the OFF position thereby causing contactor 114 to open cutting off power to coil 444 and transitioning contactor 418 between the closed and open states.

As another example, in embodiments that include both handle mounted auxiliary contacts and handle mounted lights, one or more auxiliary contacts that change state as a function of handle position, may be linked to one or more of the handle assembly lights so that handle positions are easily visually detectable from various distances. For instance, referring to FIG. 5, where a handle assembly 76 includes ON and OFF positions (see 216 and 212, respectively), one of the contacts 114 may be configured and positioned to be activated when handle assembly 76 is in the OFF position and may be wired in series with a red emitting OFF light 140. Similarly, a second handle assembly contact 112 may be configured and positioned to be activated when handle assembly 76 is in the ON position and may be wired in series with a green emitting ON light 142. In the above example, the different colored light emissions will be recognizable from extended distances to indicate handle and breaker block status. Other handle assembly positions (e.g., TRIP—see 214, RESET—see 210, etc.) may also be annunciated via handle lights.

As one other example, where power is provided to coil 444 through a circuit that does not include handle assembly contacts (e.g., through a separate start-emergency stop button assembly), one or more of the handle assembly lights may be linked in series with coil 444 to indicate whether or not current is passing through the coil. Many other circuits are contemplated wherein auxiliary contacts 108, 110, 112, and 114 are positioned in series with other assembly components (e.g., trip indicating lights, on/off lights, etc.) and, indeed, where at least one and, in many cases, more than one of the auxiliary contacts may not be linked to other block components.

Here it should be noted that, while some inventive embodiments may include both handle assembly lights as well as handle assembly auxiliary contacts, at least some embodiments will include lights and no handle assembly contacts while others will include handle assembly contacts and no handle assembly lights. In cases where the handle assembly does not include lights, the handle assembly contacts may be used in conjunction with other light devices mounted to cabinet door 72 or otherwise to communicate states/positions. Similarly, in cases where the handle assembly does not include auxiliary contacts, the handle assembly lights may be used in conjunction with other contacts in block 70 to indicate states.

Referring to FIGS. 5–11, handle assembly 76 includes a plurality of components arranged about an assembly axis 89. The assembly components include a handle member 90, a locking member 92, an intermediate member 94, a handle base member 96, an extension member 100, a light module 98, a cam member 102, a mounting member 104, a coupling member in the form of a single nut 106 and first through fourth auxiliary contacts 108, 110, 112 and 114, respectively.

Many of the handle assembly components to be described herein already have relatively complex mechanical structure which operates to facilitate various functions and which is generally well known in the art. Because much of the component structure is well known, much of the detailed structure of the components will not be described in detail. For instance, various structural aspects of handle member 90, locking member 92, intermediate member 94, extension member 100 and base member 96 cooperate to limit movement of handle member 90 to a small number (e.g., 2–4) of positions such as ON and OFF positions and to allow locking member 92 to be positioned so as to lock handle member 90 in the OFF position. The structure that limits handle movement and facilitates locking is known and hence will not be described in detail.

Referring to FIGS. 3–11, handle member 90 includes a round disk shaped member 122 and a grip member 120 that is integrally formed with disk member 122 and extends to one side thereof. Grip member 120 forms one pointed end 121 and an opposite generally rounded end 123. Pointed end 121 aligns with indicia (e.g., ON, OFF, TRIP, etc.) on a front surface 124 of base member 96 to indicate handle position.

A slot shaped channel 125 is formed in disk member 122 and grip member 120 and a front surface 117 of grip member 120 forms a recess 113 such that slot 125 opens into recess 113.

Locking member 92 is generally a flat rigid member having a receivable components 126 that, as its label implies, is received within channel 125 formed by handle member 90 and that is accessible within recess 113 when received in slot 125. Receivable component 126 forms an aperture 127 that extends therethrough. At the proximal end of component 126, extension members 129 and 131 extend laterally in opposite directions. Extension members 129 and 131 limit the extent to which locking member 92 and, more specifically, component 126, is received within slot channel 125. A spring (not illustrated) is provided between extension members 129 and 131 and oppositely facing surfaces of member 90 thereby biasing component 126 into a recessed position with respect to handle member 90. As well known in the art, this spring force can be overcome by gripping the portion of member 126 that is accessible through recess 113 and pulling member 126 against the force of the spring until aperture 127 is observable within recess 113. When aperture 127 is observable, a padlock or the like can be used to lock member 92 in the extended position.

Although not described here in detail, the structure of the handle assembly components is such that locking member 92 can only be pulled to its locking position when handle member 90 is in an OFF position and cannot be pulled into its locking position when handle 90 is in an ON position. In addition, the assembly component structures are such that, when locking member 92 is in its extended and locking positions, handle member 90 cannot be rotated from the OFF position (hence the label "locking member") to the ON or any other position.

Intermediate member 94 includes a slot end 97 and a distal extending end 95. Slot end 97 is formed to receive the portion of locking member 92 opposite component 126 and to enable sliding motion thereof along the assembly axis 89. Distal end 95 extends opposite slot end 97.

Referring to FIGS. 7 through 10, extension member 100 includes a proximal end 161 and a distal end 160. Proximal end 161 receives end 95 of intermediate member 94 and links thereto in a manner known in the art. Proximal end 161 forms a flange 87 that extends laterally to a greater radius than other parts of member 100. Distal end 160 includes an external surface that is at least in part threaded. Intermediate flange 87 and the threaded surface proximate end 160, member 100 forms two laterally extending ribs 163 and 165 that extend in opposite directions laterally from the main section of member 100. Ribs 163 and 165 are provided to lock with recesses 179 and 186 in cam member 102 to be described in greater detail below.

Figure 5:
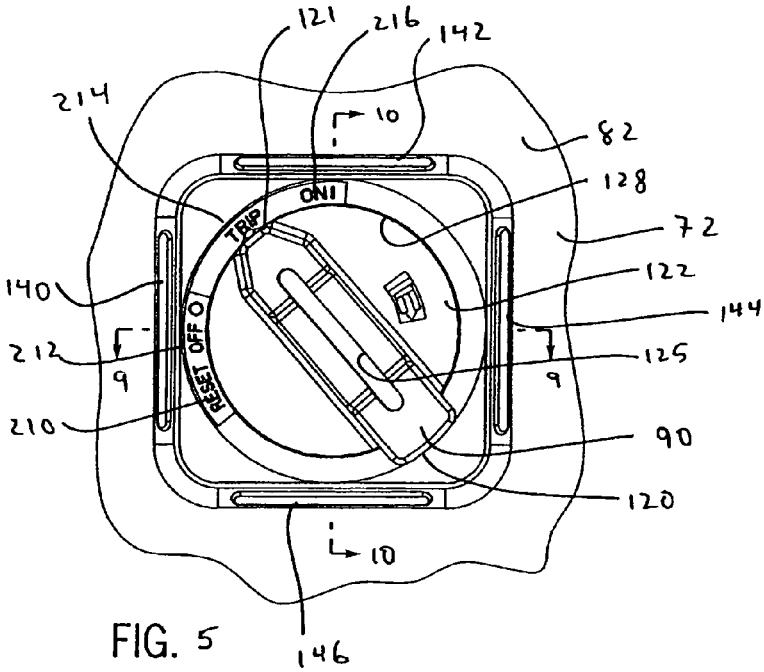
FIG. 5 is a front plan view of the handle assembly of FIG. 3.

Base member 96 is a rigid generally rectilinear member having a front surface 124 and an oppositely facing rear surface 134. Member 96 forms a central circular opening generally identified by numeral 128 and forms various structural components within opening 128 that operate with mechanical features of locking member 92, intermediate member 94 and extension member 100 to restrict handle 90 movement to only certain positions and to facilitate the locking functionality described above. In at least some embodiments of the present invention, as best illustrated in FIG. 5, indicia is provided on front surface 124 that is juxtaposed with respect to structure 130 in opening 128 such that the indicia is aligned with pointed end 121 of handle member 90 when handle assembly 76 is in a position associated with the specific indicia. For instance, exemplary indicia in FIG. 5 include "OFF" indication 212 and "ON" indication 216. When pointed end 121 of member 90 is aligned with ON indication 216, handle assembly 76 is in an ON position such that, if shaft 80 is linked thereto via distal end 160 of extension member 100, shaft 80 is likewise in an ON position. Similarly, when pointed end 121 is aligned with OFF indication 212 and shaft 80 is linked to extension member 100 for rotation therewith, shaft 80 is likewise in the OFF position.

Light module 98 includes a generally square plate member 138 that has a rib 136 around its circumference and that forms a central circular hole 150 sized to pass distal end 160 of extension member 100. Rib 136 and plate 138 generally form a cavity 137 for receiving the rear surface 134 of base member 96. Lights 140, 142, 144 and 146 are provided in rib 136. The lights may take any of several different forms including incandescent light bulbs, LEDs, etc., and may be provided in any of several different arrangements including a single light, multiple lights along one edge of rib 136, lights along opposite edges of rib 136, etc. In the illustrated embodiment a separate light is provided in each of the four rib edges. While each of the lights may emit the same color light, in at least some embodiments it is contemplated that each light may emit a different color light (e.g., red, green, yellow, blue, etc.) where each color would be associated or associable with a different handle assembly state or a different state of the breaker assembly 70.

Figure 8:
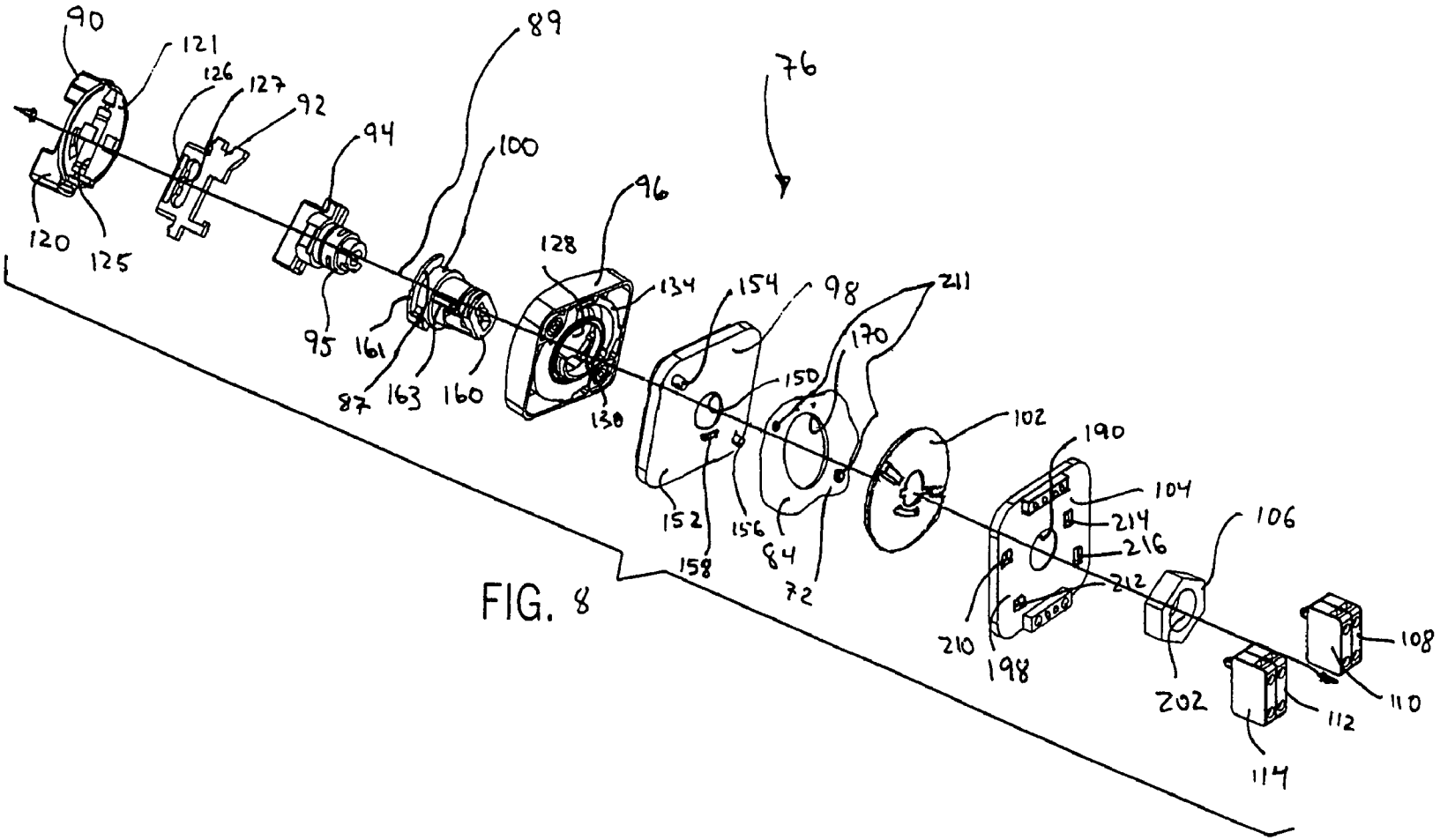
FIG. 8 is an exploded view similar to the view of FIG. 7, albeit from a different vantage point.
Figure 9:
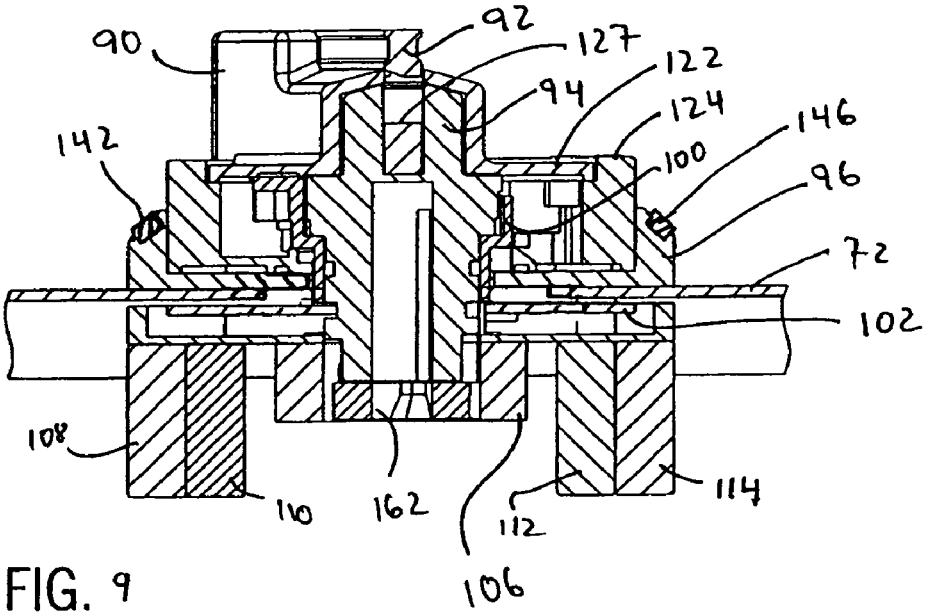
FIG. 9 is a cross-sectional view of the handle assembly of FIG. 5 taken along the line 9—9.

Referring to FIG. 8 and also to FIG. 10, an eight pin electrical port 158 is formed in a rear surface 152 just below opening 150. A separate pair of electrical conductors or leads 230 (only one shown) extends from port 158 to each of lights 140, 142, 144 and 146. In the illustrated embodiment leads 230 are potted within plate member 138 although other accommodating configurations are contemplated. Referring still to FIG. 8, two aligning pegs 154 and 156 extend perpendicular to rear surface 152 of light module 98. Pegs 154 and 156 are received within holes formed in door 72 to facilitate alignment of components on the inside and the outside of the door 72.

Referring to FIGS. 7 through 11, door 72 forms an opening 170 through which distal end 160 of extension member 100 extends. An eight pin male connector (see 196 in FIG. 7) that extends from mounting member 104 also extends through opening 170. Aligning holes 211 are provided on opposite sides of opening 170 which receive pegs 154 and 156 to align handle assembly components on both internal door surface 84 and external door surface 82.

Figure 7:
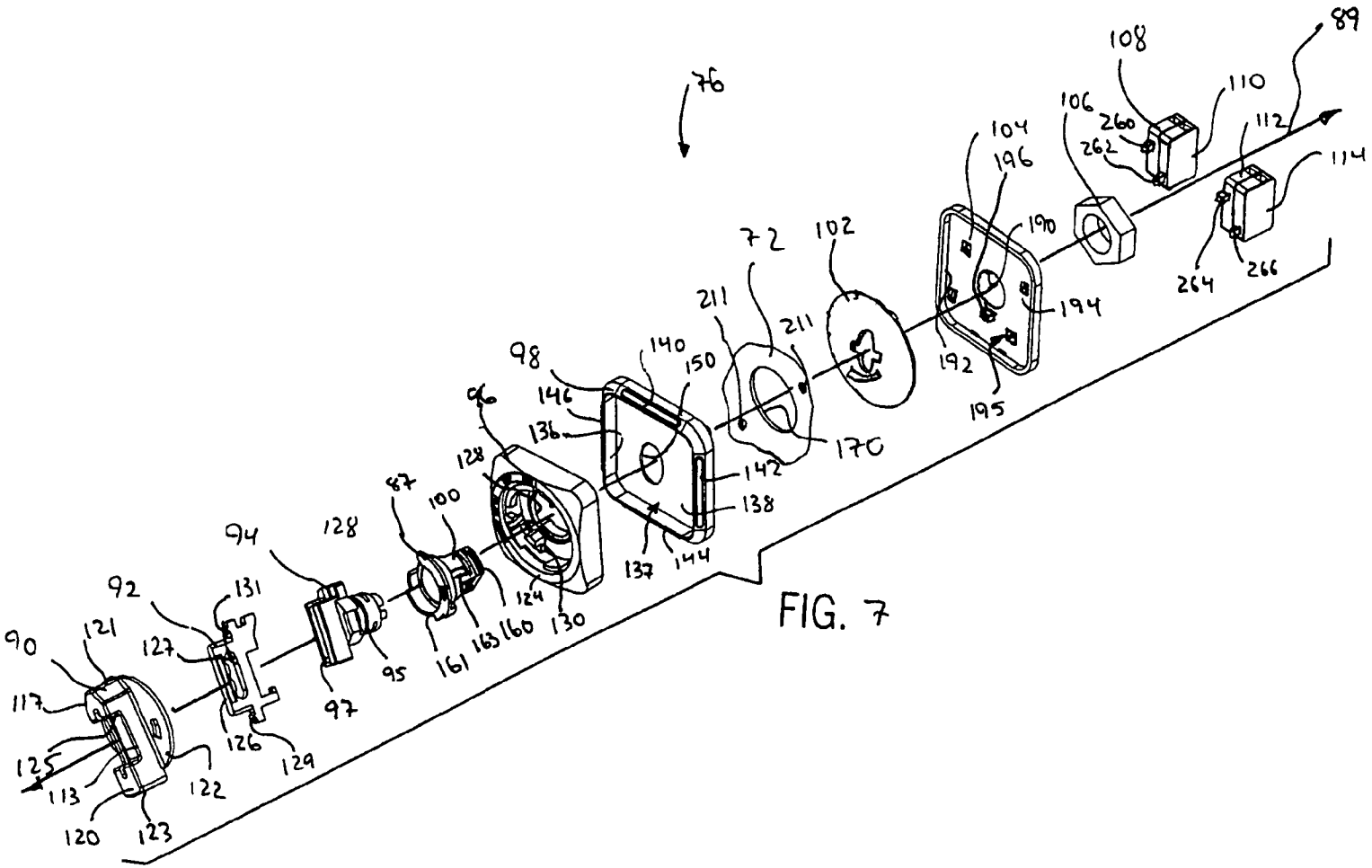
FIG. 7 is an exploded view of the handle assembly of FIGS. 4 and 5.
Figure 12:
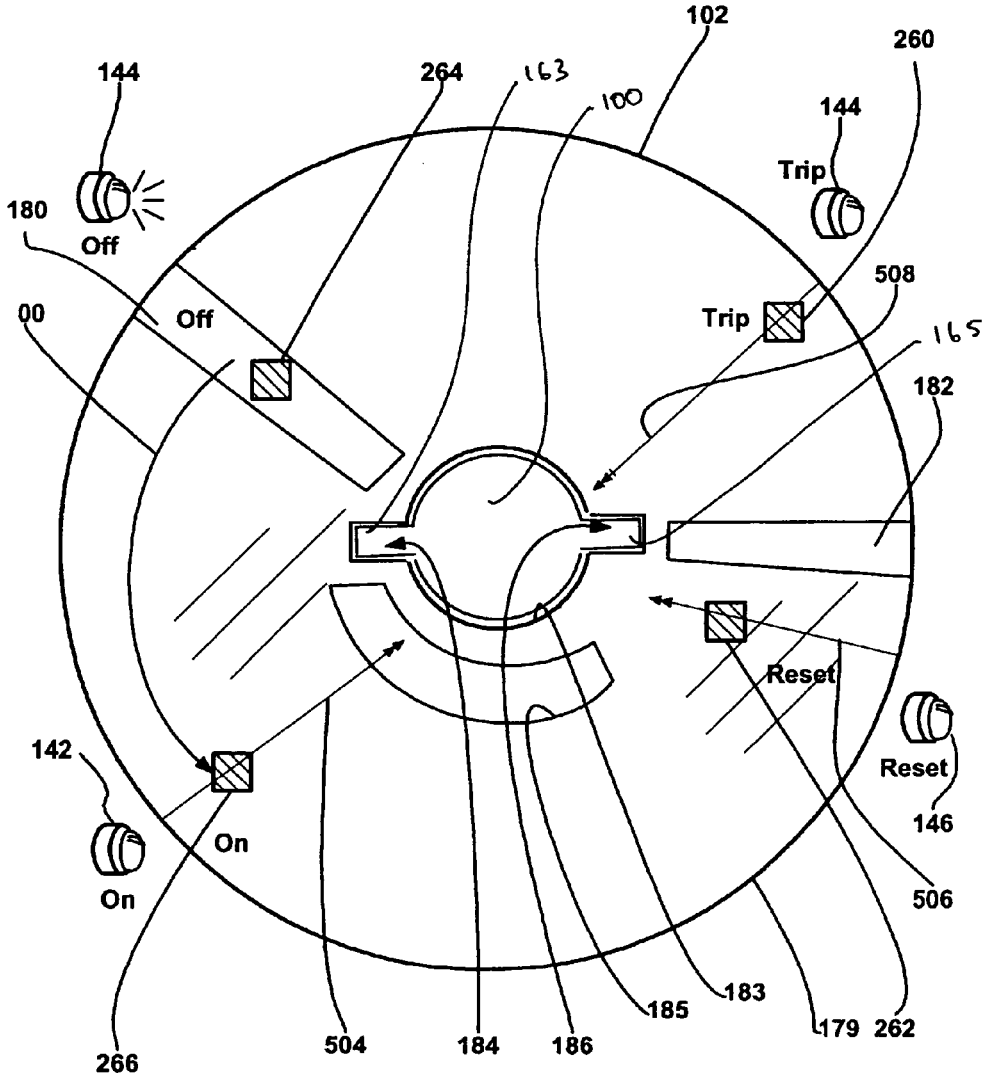
FIG. 12 is a plan view of the cam member of FIG. 7.

Referring still to FIGS. 7 and 8 and also to FIG. 12, cam member 102 is a disk shaped member forming a central circular opening 183. Two laterally extending recesses 184 and 186 are formed in opening 183 that are generally of small arc and that open in opposite directions from recess 183. Recesses 184 and 186 are sized, dimensioned and juxtaposed such that when distal end 160 of extension member 100 extends through opening 183, ribs 163 and 165 are journalled within recesses 184 and 185, respectively, so that, when extension member 100 is rotated about assembly axis 89, cam member 102 similarly rotates.

A radial slot 185 is formed to one side of opening 183 to pass male connector 196 that extend from mounting member 104 so that the distal end of the connector 196 can be linked to port 158 in the rear surface 152 of light module 98. Slot 185 is dimensioned so that connector 196 passes therethrough independent of the rotational position of cam member 102 with respect to assembly axis 89. Thus, in at least some embodiments, slot 185 will extend about an arc of 140°–150°.

Cam 102 includes two cam extensions 180 and 182 that extend from a rear cam surface 179. Each extension 180 and 182 extends from an edge of cam 102 toward opening 183 and are radially positioned with respect to recesses 184 and 186 such that the cam extensions 180 and 182 contact and depress activation members (e.g., 260 and 262 in FIG. 7) on contacts 108, 110, 112 and 114 when the cam 102 is in specific positions. The cooperative activity between extensions 180 and 182 and the activation members will be described in more detail below.

Mounting member 104 includes a generally square plate member 194 and a rib 192 that extends around the edge of plate member 194 so that plate member 194 and rib 192 form a shallow cavity 195. Plate 194 includes front and rear surfaces 194 and 198, respectively, and forms a central circular opening 190 suitably dimensioned to pass the threaded end of extension member 100. Plate 194 also forms four square shaped apertures 210, 212, 214 and 216 for passing contact activation buttons or members (e.g., 260, 262, etc.), a separate pair of the apertures 210, 212, 214 and 216 formed on each side of assembly axis 89.

Figure 10:
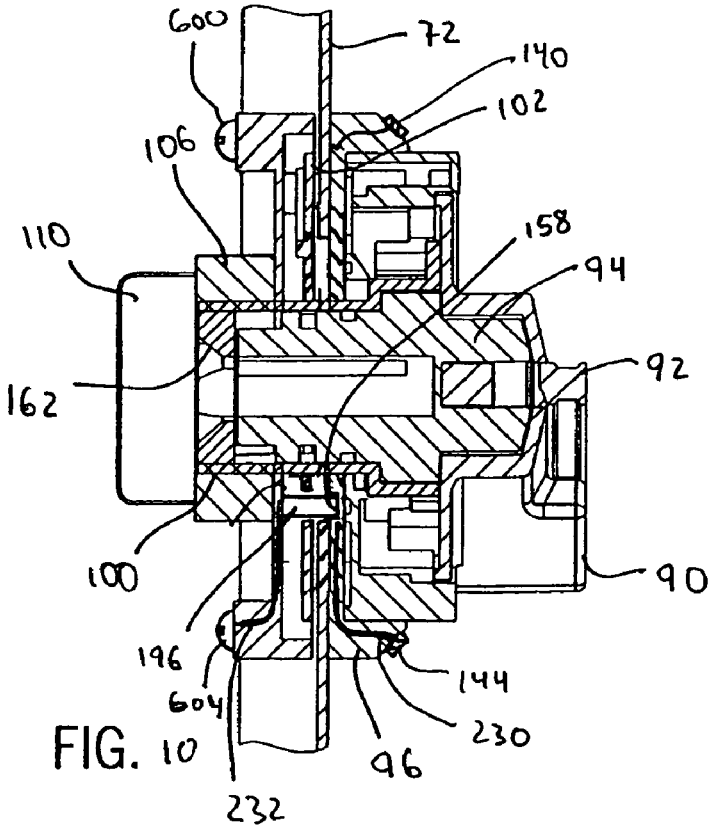
FIG. 10 is a cross-sectional view of the handle assembly of FIG. 5 taken along the line 10—10.
Figure 11:
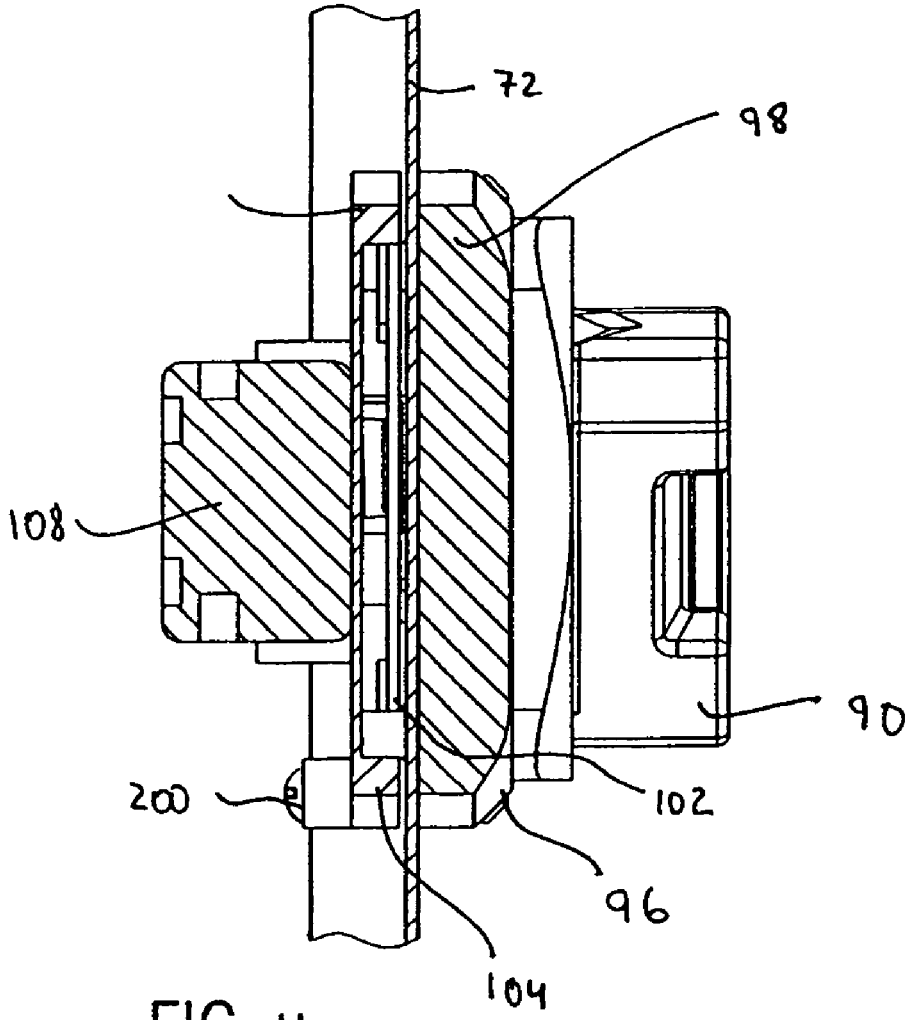
FIG. 11 is a cross-sectional view of the handle assembly of FIG. 6 taken along the line 11—11.

Referring to FIGS. 7 and 10, a male electrical connector 196 extend from plate 194 within cavity 195. Connector 196 is positioned such that the connector extend through cam slot 185 when cam 102 and mounting member are adjacent and aligned with axis 89. Connector 196 has a length dimension such that distal end thereof is receivable within port 158 (see FIGS. 8 and 10) upon assembly of handle assembly 76.

Figure 6:
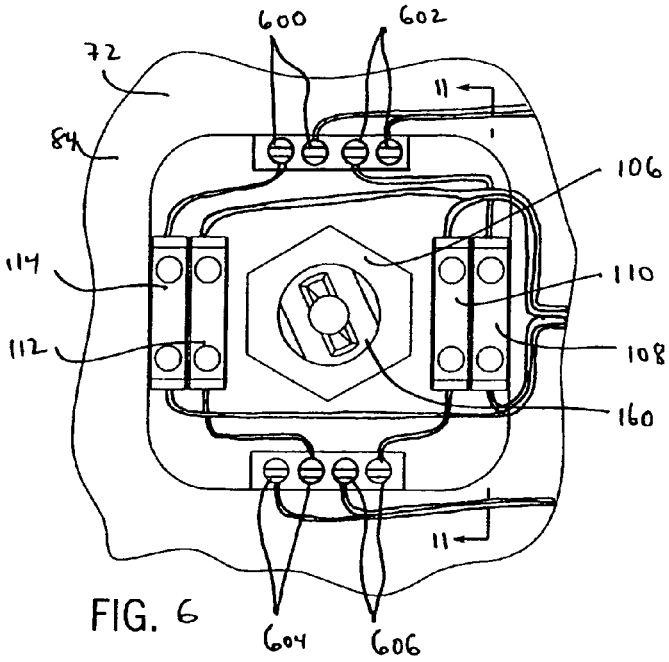
FIG. 6 is a rear plan view of the handle assembly of FIG. 4.

Referring to FIGS. 6 and 10, four pairs of connection terminals 600, 602, 604 and 606 are provided near the lower and upper edges of rear surface 198 of mounting member 104. The terminals are electrically linked with 8-pin male connector 196 (see also FIG. 7) via leads 232. In the illustrated embodiment, leads 232 are potted within plate 198 although other accommodating configurations are contemplated. Referring also to FIGS. 7 and 8, when connector 196 is received in port 158, lights 140, 142, 144 and 146 are electrically linked to terminal pairs 600, 602, 604 and 606, respectively.

Referring to FIGS. 7 through 11, nut 106 forms a threaded aperture 202 dimensioned to be threadably receivable on distal end 160 of extension member 100. Each of contacts 108, 110, 112 and 114 is a normally closed contact although in some embodiments one or more normally open contacts may be provided. Each of contacts 108, 110, 112 and 114 is mechanically activated to change state by depression of an associated push button type activation member. For instance, contact 108 includes a push button 260 that, when pressed, causes contact 108 to close and, when released, allows contact 108 to again open. Activation members for contacts 110, 112, and 114 are identified by numerals 262, 264 and 266, respectively. The activation members have length dimensions such that they extend through apertures 210, 212, 214 and 216 formed in plate 198 and into cavity 195 (see again FIG. 7) when the contacts are mounted to rear surface 198. Referring again to FIG. 12, when one of the cam extensions 180 or 182 is aligned with one of the activation members 210, 212, 214 or 216, the cam extension contacts and depresses or activates the activation member thereby causing the associated contact to transition to the closed state.

Referring again to FIGS. 4, 5 and 15, the handle assembly components are configured such that, when assembly 76 is linked to shaft 80, handle member 90 is rotatable through 90° of rotation between an ON position in which circuit breaker switches 425, 426 and 458 are closed and an OFF position in which switches 425, 426 and 458 are open. In addition, when breaker 416 is tripped and automatically opened, handle member 90 is rotated 30° counter-clockwise from the ON position. After the breaker trips, an operator is required to reset the breaker assembly prior to moving handle 90° to the ON position by rotating handle approximately 80° counter-clockwise (i.e., approximately 20° past the OFF handle position) into the RESET position.

In the illustrated embodiment, referring also to FIGS. 7, 8 and 12, when cam 102 is journalled to extension member 100 for rotation therewith and the other assembly 76 components are assembled, cam extension 180 is aligned with contact activation member 264 (the activation members illustrated in FIG. 12 as cross-hatched squares) when handle 90 is in the OFF position. When handle member 90 is rotated counter-clockwise to the RESET position, cam extension 182 contacts and activates activation member 262.

In FIG. 12, the rear surface of cam member 102 is illustrated. When viewing the rear surface of cam 102 the frame of reference is opposite that of handle assembly 76 as viewed in FIG. 5 (i.e., when handle member 90 is rotated counter-clockwise in FIG. 5, the rear surface of cam 102 in FIG. 12 rotates clockwise and vice versa). Thus, when handle member 90 is rotated counter-clockwise 200 to the RESET position in FIG. 5, cam member 102 rotates 200 clockwise so that extension 182 is aligned with arrow 506 and activates activation button 262. Similarly, when handle 90 is rotated to the ON position, cam extension 180 is aligned with arrow 504 and activates activation member 266 and when handle member 90 is in the TRIP position, cam 182 is aligned with arrow 508 and activates activation member 260.

Referring again to FIGS. 7 through 12, handle assembly 76 is assembled about assembly axis 89 as follows. Extension component 126 is received within slot 125 of handle member 90 and the opposite end of locking member 92 is received by the slot end 97 of intermediate member 94. End 95 of intermediate member 94 is received by end 161 of extension member 100. End 160 of extension member 100 is received through opening 128 of base member 96. Base member 96 is aligned with cavity 137 formed by light module 98 and rear surface 134 of base member 96 is received within cavity 137. Light module 98 is aligned with opening 170 and such that pegs 154 and 156 are aligned with alignment apertures 211 and module 98 is held against the external surface 82 of door 72.

Continuing, with distal end 160 of extension member 100 extending through opening 170, cam member 102 is aligned with end 160 and slid thereon such that ribs 163 and 165 (see again FIG. 12) are journalled within recesses 184 and 186, respectively. Mounting member 104 is positioned such that the distal end 160 of extension member 100 is aligned with opening 190 and is moved toward internal surface 84 of door 72 such that end 160 passes through opening 190. Here, distal ends of pegs 154 and 156 are receivable within corners formed by rib 192 and therefore help align mounting member 104 with module 154 despite the fact that those components are on opposite sides of door 72. When module 104 is properly positioned, male connector 196 extends through slot 185 (see again FIG. 12) and are received within port 158 such that terminals 600, 602, 604 and 606 are electrically linked to light 140, 142, 144 and 146 as described above.

Nut 106 is threadably received on distal end 160 of extension member 100 and bears against the rear surface 198 of member 104 thereby holding all of the handle assembly components together. Contacts 108, 110, 112 and 114 are mounted to rear surface 198 of mounting member 104 such that activation members (i.e., the push buttons) 260, 262, 264 and 266 extend through apertures 214, 216, 210 and 212 in mounting member 104.

While the assembly components described above are described as being assembled in a certain order, it should be appreciated that some of the components may be pre-assembled into subassemblies prior to final assembly. For instance, contacts 108, 110, 112 and 114 would likely be pre-mounted to member 104 prior to final assembly. In addition, members 90, 92, 94, 100 and 96 and module 98 may be pre-assembled prior to final assembly. Moreover, module 98 may be separate from the pre-assembled subassembly including members 90, 92, 94, 100 and 96.

Importantly, with the assembly described above, the components can be electrically linked in various ways to perform various functions. For instance, any of the lights 140, 142, 144 and 146 may be linked in series with any contacts (none illustrated) located within cabinet 71 to visually annunciate the status of the contact during system operation. In addition, any of the lights or a subset thereof may be linked in series with any of the handle mounted auxiliary contacts 108, 110, 112 or 114 to visually annunciate (i.e., illuminate an associated light) the status of the handle assembly 76. For instance, referring again to FIGS. 4, 6 and 15, contact 112 may be linked in series with a low voltage power source and light 144 via terminal pair 604. Here, because contact 112 is normally open, when handle member 90 and hence cam 102 are in the OFF position (see cam 102 position in FIG. 12), contact 112 provides power to light 144 and visually annunciates that handle 90 is in the OFF position. When handle member 90 and cam 102 are rotated from the OFF position, cam extension 180 releases member 264 and contact 112 opens to turn off light 144.

Referring still to FIGS. 5, 6 and 15, contact 114 may be linked in series with light 140 via terminal pair 600. Here referring also to FIG. 12, when cam 102 and handle member 90 are rotated to the ON position, cam extension 180 activates member 266 (see arrow 504) to close contact 114 and illuminate light 140 to indicate the ON handle position. Similarly, contact 110 may be linked in series with light 146 via terminal pair 606 so that when cam 102 and handle 90 are rotated to the RESET position, cam extension 182 activates member 262 (see arrow 506) to close contact 110 and illuminate light 146 indicating the RESET handle position. Moreover, contact 108 may be linked in series with light 142 via terminal pair 602 so that when cam 102 and handle member 90 are in the tripped position, cam extension 182 activates member 260 (see arrow 508) to close contact 108 and illuminate light 142 to indicate the handle TRIP position.

In the above example, while each of the contacts 108, 110, 112 and 114 may be linked to separate lights 140, 142, 144 and 146, in at least some cases only a subset of the linkages maybe made. For instance in some cases only ON and OFF lights 140 and 144 may be linked to contacts. Where only a subset of the contacts are linked to lights, the other contacts may be linked to other components within cabinet 71. In addition, in some cases two or more of the handle lights may be linked in series with a single one of the contacts. For instance, contact 108 may be linked in series with all of lights 140, 142, 144 and 146 so that all of the lights are illuminated when a TRIP condition occurs.

In at least some embodiments it is contemplated that the contacts 108, 110, 112 and 114 may be pre-wired to specific terminal pairs or indeed directly to specific pins on connector 196 so that the contact functions cannot be altered. Here, versatility in assembly 76 functionality may still be achievable by providing two or more swappable cam members 102 where the different cam members have different cam extension characteristics. For instance, while a first cam member may have the characteristics illustrated in FIG. 12, a second cam member (not illustrated) may only include cam extension 180 and may not include extension 182. Here, when the first cam 102 is employed the handle assembly would be capable of illuminating a different handle light for each of the ON, OFF, TRIP, and RESET positions. However, when the second cam is employed the handle assembly would only be capable of illuminating separate handle lights for the ON and OFF positions.

Figure 13:
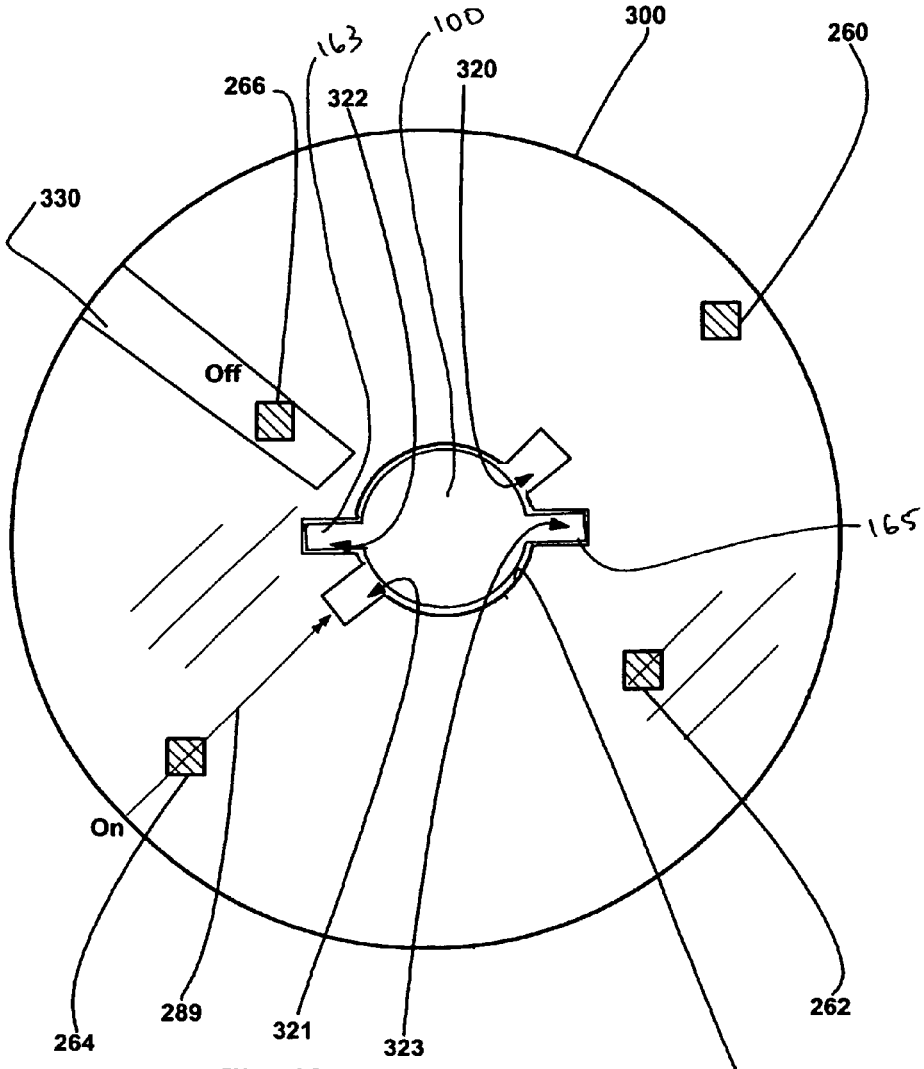
FIG. 13 is a similar to FIG. 12, albeit illustrating a second cam member embodiment in a first juxtaposition.

In other embodiments a single cam member may be securable to extension member 100 in two or more relative juxtapositions where the cam extension configuration operates differently in the different juxtapositions. For instance, in FIG. 13 a different cam member 300 is illustrated which includes only a single cam extension 330 but that forms two pairs of recesses in a central opening 332. The first pair 322 and 323 are arranged with respect to cam extension 330 such that, when ribs 163 and 165 on member 100 are journalled therein, cam extension 330 operates in a fashion similar to that described above with respect to FIG. 12 to activate members 264 and 266 when the handle member 90 is in the OFF (illustrated) and ON (see arrow 289) positions, respectively. In addition, when ribs 163 and 165 are journalled in recesses 322 and 323, no cam extensions interact with activation members 260 and 262 in any of the handle positions.

The second recess pair 320 and 321 are angularly offset from pair 322 and 323 and are juxtaposed with respect to cam extension 330 such that when ribs 163 and 165 are journalled in recesses 322 and 323, respectively, as illustrated in FIG. 14, cam extension 330 is aligned between activation members 260 and 262. Here, cam extension 330 activates member 260 when handle member 90 is in the TRIP position (i.e., when extension 330 is aligned with arrow 352) and activates member 262 when handle member 90 is in the RESET (i.e., when extension 330 is aligned with arrow 350). Here, when ribs 163 and 165 are journalled in recesses 320 and 321, no cam extensions interact with activation members 264 and 266 in any of the handle positions.

At this point it should be appreciated that a unique exemplary hardware configuration has been described that includes several cooperating components. However, it should also be understood that other similar configurations are contemplated. For instance, while the assembly 76 above includes four contacts 108, 110, 112 and 114, it should be appreciated that assemblies with fewer and greater numbers of contacts are contemplated. Also, in some cases all or a subset of the handle assembly contacts may be provided outside cabinet 71. Moreover, more or less than four lights may be included in the handle assembly 76. In addition, in some cases the light module 98 may be replaced with lights on the handle member 90 or in the base member 96.

Furthermore, embodiments including more than two swappable cam members are contemplated where each of the cam members has different camming characteristics such that an extremely versatile handle assembly results. In addition, while an embodiment having a swappable cam is described above, other embodiments are contemplated where mounting members 96 are swappable to provide similar variable functionality by altering the relative juxtapositions of cam extensions and the contact activation members.

Moreover, embodiments are also contemplated where a single mounting member 96 and associated contacts may be positionable in more than one relative juxtaposition with respect to the base member 96 so as to alter the juxtapositions of contact activation members and the cam extensions and hence alter functionality. In addition, in at least some embodiments, the cam member may be eliminated and the cam extension(s) may be provided as an integral part(s) of the extension member 100. In cases where the handle assembly does not include auxiliary contacts, the cam member 102 may be completely eliminated.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

To apprise the public of the scope of this invention, the following claims are made:

What is claimed is:

1. A handle assembly for use with a control assembly including a circuit disconnector located on a first side of a planar member forming an opening, the disconnector including a first mechanical linkage having open and closed positions, the assembly comprising:

a handle member moveable between at least first and second positions and mounted on a second side of the planar member adjacent the opening;

an extension member rigidly connected to and extending from the handle member through the opening and forming a second mechanical linkage at a distal end that is linkable with the first mechanical linkage, the extension member moving the first mechanical linkage between the closed and open positions when the handle is moved between the first and second positions, respectively:

a cam at least linkable to at least one of the handle member and the extension member for movement therewith; and at least a first contact that is separate from the circuit disconnector and including a activation member, the first contact closing when the activation member is activated, the cam, extension member and activation member positionable in a first relative juxtaposition with respect to each other such that when the handle member is in one of the first and second positions, the cam activates the activation member and, when the handle member is in the other of the first and second positions, the cam releases the activation member.

2. The assembly of claim 1 wherein the cam is at least linkable to the extension member and is positioned on the first side of the planar member.

3. The assembly of claim 2 wherein the cam, extension member and activation member are positionable in a second relative juxtaposition with respect to each other such that when the handle member is in the one of the first and second positions, the cam releases the activation member and, when the handle member is in the other of the first and second positions, the cam member activates the activation member.

4. The assembly of claim 3 wherein the contact is mounted in a first position with respect to the planar member and wherein the relative juxtapositions of the cam, extension member and activation member are modifiable by altering the position of the cam with respect to the extension member.

5. The assembly of claim 3 wherein the relative juxtapositions of the cam, extension member and activation member are modifiable by altering the position of the contact with respect to the planar member.

6. The assembly of claim 3 wherein the cam, extension member and activation member are positionable with respect to each other such that the cam, extension member and activation member are in a third relative juxtaposition with respect to each other such that the cam releases the activation member when the handle member is in either of the first and second positions.

7. The assembly of claim 6 wherein the handle is moveable to a third position and wherein, when the extension member, cam and contact are in the third relative juxtaposition and the handle member is in the third position, the cam activates the activation member.

8. The assembly of claim 2 wherein the activation member is a first activation member, the assembly further including at least a second contact including a second activation member, the second contact closing when the second activation member is activated, the second contact juxtaposed with respect to the planar member such that when the first contact, cam and extension member are in the first relative juxtaposition with respect to each other and the handle member is in the other of the first and second positions, the cam activates the second activation member and, when the handle member is in the one of the first and second positions, the cam releases the second activation member.

9. The assembly of claim 8 wherein the first contact, cam and extension member are positionable in a second relative juxtaposition with respect to each other such that when the handle member is in the one of the first and second positions, the cam releases the first activation member.

10. The assembly of claim 2 also for use with a power source and further including a light emitter positioned on the second side of the planar member and linkable to the power source via the contact.

11. The assembly of claim 10 further including terminals disposed on the first side of the planar member that are electrically linked to the light emitter wherein the terminals are linkable to the source and the contact.

12. The assembly of claim 1 further including a mounting member and a coupling member, the coupling member receivable by the extension member to secure the mounting member adjacent the first side of the planar member.

13. The assembly of claim 12 wherein the at least a first contact is mounted to the mounting member.

14. The assembly of claim 12 wherein an external surface of the extension member forms a thread and wherein the coupling member includes a single threaded nut receivable on the extension member to sandwich the mounting member between the nut and the first side of the planar member.

15. The assembly of claim 2 further including a base member, a mounting member and a coupling member, the base member sandwiched between the handle member and the second side of the planar member, the cam sandwiched between the mounting module and the first side of the planar member, the coupling member linkable to the extension member and the mounting member sandwiched between the coupling member and the cam, the first contact mounted to the mounting member.

16. The assembly of claim 15 wherein at least a portion of the external surface of the extension member is threaded and wherein the coupling member includes a single threaded nut receivable by the threaded surface of the extension member.

17. The assembly of claim 15 further including a light module sandwiched between the base member and the second side of the planar member, the light module including at least a first light emitter and conductive leads that extend from the first emitter through the opening formed by the planar member.

18. The assembly of claim 17 wherein the mounting member includes terminals for each of the light emitters, the terminals linked to the conductive leads.

19. The assembly of claim 1 further including a mounting member adjacent the first side of the planar member, the at least a first contact mounted to the mounting member.

20. The assembly of claim 19 wherein the cam, extension member and activation member are positionable in a second relative juxtaposition with respect to each other such that when the handle member is in the one of the first and second positions, the cam releases the activation member and, when the handle member is in the other of the first and second positions, the cam member activates the activation member.

21. The assembly of claim 20 wherein the relative juxtapositions of the cam, extension member and activation member are modifiable by altering the position of the mounting member with respect to the planar member.

22. A handle assembly for use with a planar member forming an opening and having first and second sides, the assembly comprising:

a handle member moveable between at least first and second positions and mounted on the second side of the planar member adjacent the opening;

an extension member rigidly connected to and extending from the handle member through the opening;

a cam at least linkable to at least one of the handle member and the extension member for movement therewith; and at least a first contact including a activation member, the first contact closing when the activation member is activated, the cam, extension member and activation member positionable in a first relative juxtaposition with respect to each other such that when the handle member is in one of the first and second positions, the cam contacts and activates the activation member and, when the handle member is in the other of the first and second positions, the cam releases the activation member.

23. The assembly of claim 22 wherein the cam is at least linkable to the extension member and is positioned on the first side of the planar member.

24. A handle assembly for use with a planar member forming an opening and having first and second sides, the assembly comprising:

a handle member moveable between at least first and second positions and mounted on the second side of the planar member adjacent the opening;

an extension member rigidly connected to and extending from the handle member through the opening;

a cam at least linkable to at least one of the handle member and the extension member for movement therewith; and at least a first contact including a activation member, the first contact closing when the activation member is activated, the cam, extension member and activation member positionable in a first relative juxtaposition with respect to each other such that when the handle member is in one of the first and second positions, the cam activates the activation member and, when the handle member is in the other of the first and second positions, the cam releases the activation;

wherein the cam, extension member and activation member are positionable in a second relative juxtaposition with respect to each other such that when the handle member is in the one of the first and second positions, the cam releases the activation member and, when the handle member is in the other of the first and second positions, the cam member activates the activation member.

25. The assembly of claim 22 wherein the contact is mounted in a first position with respect to the planar member and wherein the relative juxtapositions of the cam, extension member and activation member are modifiable by altering the position of the cam with respect to the extension member.

26. The assembly of claim 24 wherein the relative juxtapositions of the cam, extension member and activation member are modifiable by altering the position of the contact with respect to the planar member.

27. The assembly of claim 22 wherein the activation member is a first activation member, the assembly further including at least a second contact including a second activation member, the second contact closing when the second activation member is activated, the second contact juxtaposed with respect to the planar member such that when the first contact, cam and extension member are in the first relative juxtaposition with respect to each other and the handle member is in the other of the first and second positions, the cam activates the second activation member and, when the handle member is in the one of the first and second positions, the cam releases the second activation member.

28. The assembly of claim 27 wherein the first contact, cam and extension member are positionable in a second relative juxtaposition with respect to each other such that when the handle member is in the one of the first and second positions, the cam releases the first activation member.

29. The assembly of claim 22 also for use with a power source and further including a light emitter positioned on the second side of the planar member and linkable to the power source via the contact.

30. The assembly of claim 29 further including terminals disposed on the first side of the planar member that are electrically linked to the light emitter wherein the terminals are linkable to the source and the contact.

* * * * *